United States Patent [19]

Dalmau Güell et al.

[11] Patent Number: 4,754,936

[45] Date of Patent: Jul. 5, 1988

[54] YARN FEED DEVICE FOR TEXTILE MACHINES

[75] Inventors: José M. Dalmau Güell, Barcelona; Miguel Gabarrós Montaner, Vic, both of Spain

[73] Assignees: Jumberca S.A.; Torres Y CIA. S.A., both of Barcelona, Spain

[21] Appl. No.: 65,504

[22] Filed: Jun. 23, 1987

[30] Foreign Application Priority Data

Jun. 23, 1986 [ES] Spain ..... 556.406

[51] Int. Cl.[4] ..... B65H 51/20; B65H 59/00

[52] U.S. Cl. ..... 242/47.01; 66/132 R; 242/45

[58] Field of Search ..... 242/47.01, 47.04, 47.08, 242/47.09, 47.12, 47.13, 47, 45; 226/168, 174, 188; 66/132 R, 132 T; 139/452; 28/240, 241

[56] References Cited

U.S. PATENT DOCUMENTS

| | | | |
|---|---|---|---|
| 2,160,495 | 5/1939 | Francis | 242/45 |
| 2,269,299 | 1/1942 | Wiggins | 242/45 |
| 3,093,330 | 6/1963 | Schmidt | 242/45 |
| 3,202,371 | 8/1965 | Parker | 242/47.01 |
| 3,323,753 | 6/1967 | Spurgeon | 242/45 X |
| 3,831,873 | 8/1974 | Bense | 242/47.01 X |
| 3,831,874 | 8/1974 | Andrew et al. | 242/47.01 |
| 4,545,543 | 8/1985 | Plucknett | 242/47.01 |
| 4,598,560 | 7/1986 | Sawazaki | 242/47.08 X |

*Primary Examiner*—Stanley N. Gilreath
*Attorney, Agent, or Firm*—Staas & Halsey

[57] ABSTRACT

A plurality of yarn guides causes a yarn being drawn from a yarn package or the like to be directed towards a needle of a textile machine along a path which forms at least two tangential arcs with the cylindrical surface of a rotatable feed drum. When the yarn is subjected to tension, as when it is required by the needle, it presses against the drum and the yarn is pulled along by the rotation of the drum. Enough friction is provided on the surface of the drum so that it will pull the yarn. When the tension is released, there is no yarn feed.

8 Claims, 2 Drawing Sheets

YARN FEED DEVICE FOR TEXTILE MACHINES

BACKGROUND OF THE INVENTION

1. Field of the Invention

The invention relates to a yard feed device for textile machines, of the type comprising an inlet yarn guide for receiving the yarn from a package, cone or like supply member; a feed drum having a cylindrical surface which may be engaged by the yarn extending from the inlet yarn guide; means for causing said feed drum to rotate; and an outlet yarn guide from which the yarn is supplied to a needle of a textile machine.

2. Description of the Related Art

Many textile machines, particularly circular knitting machines, are provided with needle selection systems for knitting jacquard fabrics. Such selections are very varied and irregular, relative to the amount of needles being selected.

The number of needles being raised continuously to take yarn for knitting varies in each knitting system of the machine, consuming the yarn in a very irregular, intermittent way.

The so-called positive feed yarn feeders on the market are not prepared for intermittent yarn supplying, so they are inapplicable to such machines. They may only be used when the selector systems are taken out of service and all or part of the needles knit continuously.

There are other feed systems, known as yarn accumulation or yarn storage feed because of the large number of turns of yarn wrapped around the corresponding drum, which are particularly designed for intermittent supply of yarn. Nevertheless, the size thereof makes them troublesome to mount, and furthermore, the working system thereof requires a substantial investment, since, among other factors, they generally require an independent motor. The majority of these yarn feeders are not effective when the machine is knitting continuously, since the outgoing yarn speed is substantially slower than the incoming yarn speed, whereby no positive feed is produced.

SUMMARY OF THE INVENTION

The object of the invention is to provide a yarn feed device capable of supplying yarn in the amount required each time by the needle, and further, to provide such a yarn feed device capable of producing a positive feed (i.e. feeding a regular constant yarn supply) as referred to above, requiring therefor only small changes which may be easily and speedily effected.

The yarn feed device according to the invention is characterized in that there is a first intermediate yarn guide disposed substantially diametrally opposite an inlet yarn guide on the other side of a feed drum, and at least one second intermediate yarn guide substantially adjacent the inlet yarn guide, such that the yarn extending from the inlet yarn guide to the first intermediate yarn guide and from the latter to the second intermediate yarn guide maintains arcs of tangency with the drum substantially smaller than the total perimeter of the drum and in that the cylindrical surface of the feed drum is adapted to pull the yarn engaging the surface in these arcs of tangency only when the yarn is under tension, on being required by the needle.

BRIEF DESCRIPTION OF THE DRAWINGS

Further objects and features of the invention are disclosed in the following description of a preferred non-limitative embodiment of the invention to be taken jointly with the accompanying drawings.

DETAILED DESCRIPTION OF PREFERRED EMBODIMENTS

Figure 1:
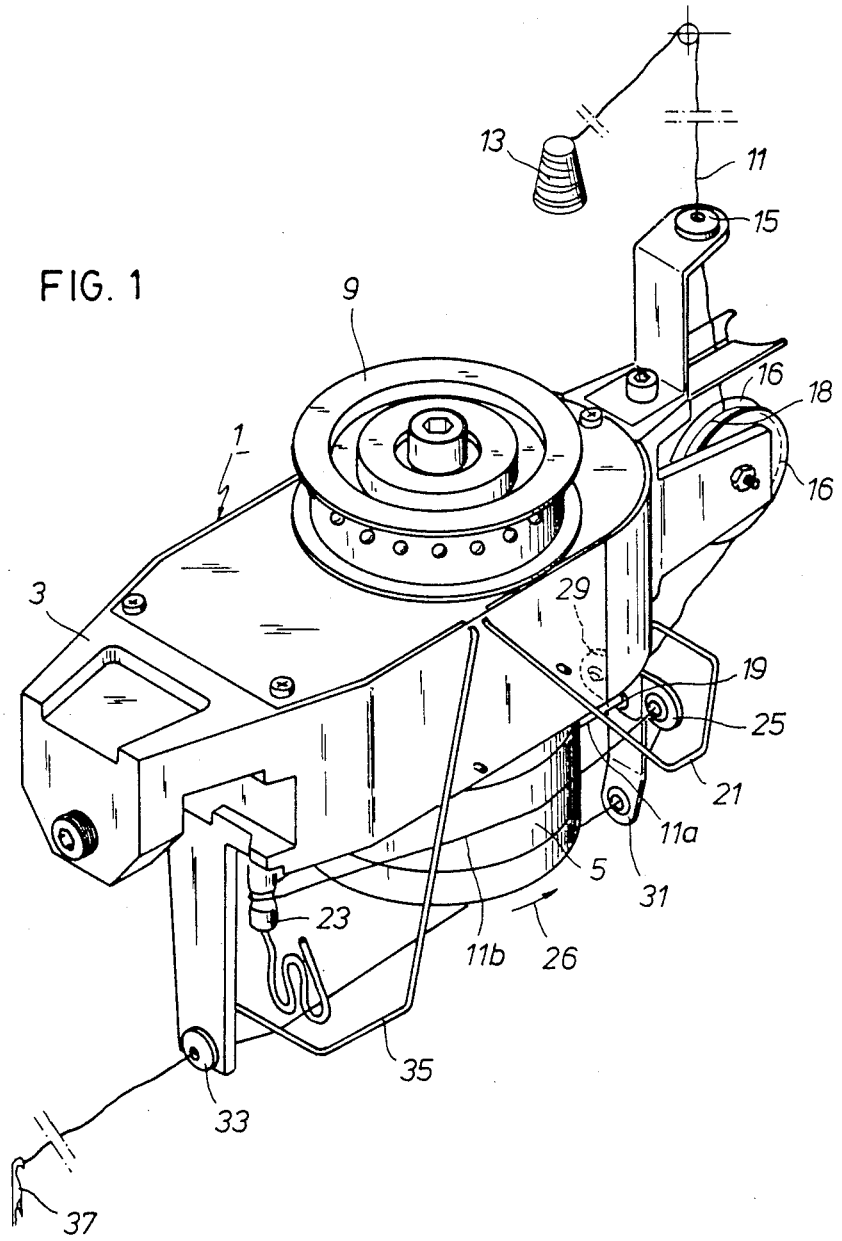
FIG. 1 is a perspective view illustrating the yarn feed device of the invention, the yarn supply package or cone from which the feed device receives the yarn, and the needle which receives the yarn from the feed device.
Figure 2:
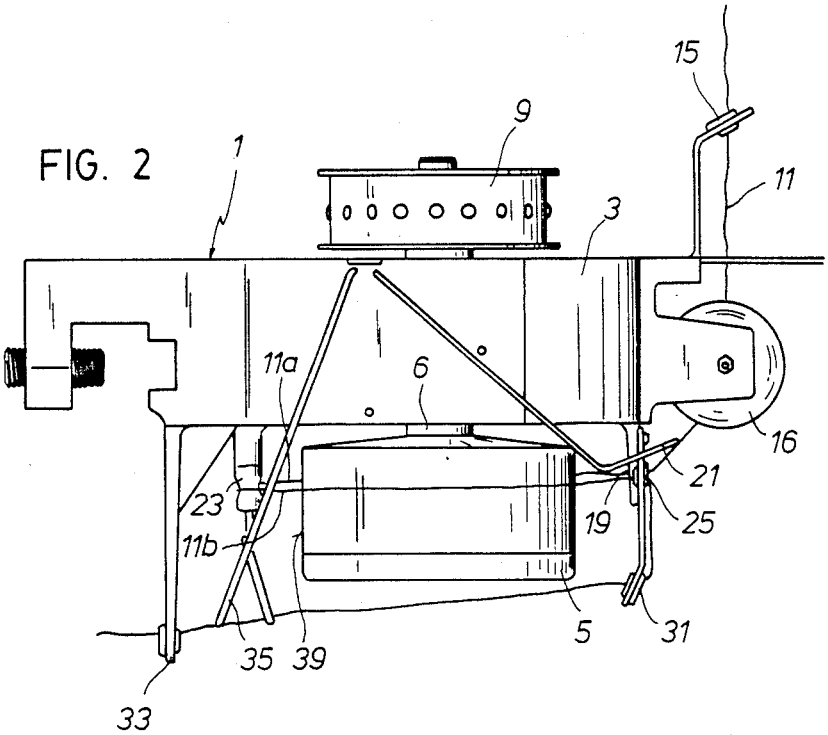
FIG. 2 is an elevational view of the yarn feed device of FIG. 1.

The yarn feed device 1 comprises a frame 3 in which there is mounted a feed drum 5 which is rotatable around a shaft 6 as illustrated in FIGS. 1 and 2. The drum 5 is coaxial with a pulley 9 which may be driven by a belt or like means (not shown); the mechanical connection thereof with the drum 5 causes the latter to rotate when the pulley 9 is driven.

The feed device receives yarn 11 from a yarn package, cone or like member 13, shown schematically in FIG. 1. The yarn may pass through an outermost yarn guide 15 and thereafter through a passage 18 defined between two mutually facing discs 16, 16. The discs 16, 16 are capable of detecting any undesired variation in the thickness of the yarn 11. Thereafter, the yarn 11 passes through an inlet yarn guide 19. A first sensor 21 is located between the discs 16, 16 and the inlet yarn guide 19 to bear against the yarn 11 such that any breakage of the yarn 11 is detected by the sensor 21.

Substantially opposite the inlet yarn guide 19 on the other side of the drum 5 there is a first intermediate yarn guide 23, such that the portion 11*a* of yarn extending between the inlet yarn guide 19 and the first intermediate yarn guide 23 forms a relatively small tangential arc with the drum 5.

Substantially adjacent the inlet yarn guide 19 there is a second intermediate yarn guide 25. The portion 11*b* of the yarn extending between the intermediate yarn guides 23 and 25 also forms a relatively small tangential arc with the drum 5. The extension of such tangential arcs depends solely on the positions of the inlet yarn guide 19 and the intermediate yarn guides 23 and 25 relative to the drum 5.

When the drum 5 rotates in the direction of the arrow 26, the second intermediate yarn guide 25 is located as shown in FIGS. 1 and 2, and the same is true of the yarn portions 11*a* and 11*b*. When the drum 5 rotates in the opposite direction, an alternative second intermediate yarn guide 29 is contemplated, as shown in phantom line in FIG. 1 on the opposite side of the inlet yarn guide 19 from the intermediate yarn guide 25. In this case, the yarn extends from the yarn guide 19 to the yarn guide 23 and from the latter to the yarn guide 29 in the opposite direction to the one shown.

From the second intermediate yarn guide 25 or, as the case may be, from the alternative yarn guide 29, the yarn extends to a third intermediate yarn guide 31 and therefrom to an outlet yarn guide 33, such that this portion of yarn is located out of engagement with the feed drum 5. A second sensor 35 bears against the yarn in the portion extending between the yarn guides 31 and 33, such that any breakage of the yarn is detected by the sensor.

The third yarn guide 31 is not required if the yarn between the second intermediate yarn guide 25 (29) and the outlet yarn guide 33 has to extend of necessity remote from the drum 5.

The yarn passes from the outlet yarn guide 33 towards a needle 37. Other mechanisms have been omitted from the FIGS. 1 and 2 as not being necessary for an understanding of the feed device of the invention.

The feed drum 5 is provided with a cylindrical surface 39 prepared to pull on the yarn engaging the surface 39 when under tension, i.e. when being taken up by the needle 37. As explained above, the engagement only takes place following the arcs of tangency. For the yarn to be pulled along, the cylindrical surface 39 may not be made from smooth, polished metal, since in such case the necessary adherence would be missing, and the yarn would slide over the drum surface 39, and there would be no feeding. To provide for pulling of the yarn, it is contemplated that the surface be made of rubber, leather, synthetic elastomer, plastics or any other appropriate material; it is also contemplated that the cylindrical surface may be provided by an exchangeable liner, to allow for replacement after wear.

The cylindrical surface 39 of the feed drum 5 may also be metallic if provided with striations, knurling or any other type of surface roughness. Under these conditions, there is the necessary adherence for pulling the yarn, although in certain cases the yarn may be damaged by contact with the hard metal surface or by any surface snag thereof.

The feed drum 5 rotates while the textile machine is running. When the needle 37 does not require yarn, the latter is not under tension and therefore the yarn portions 11*a* and 11*b* slide gently over the drum, without adhering thereto, whereby the drum 5 does not feed the yarn. When the needle 37 requires yarn, the latter is under tension and, therefore, the arcs of tangency, that is, the part corresponding to the portions 11*a* and 11*b*, are forceably engaged with the drum 5, whereby this pulls the yarn and the needle 37 receives the yarn it needs. Likewise, this yarn feed is interrupted when the needle 37 ceases to need yarn, since the tension is also released.

In the so-called positive feed feeders, the yarn comes in through an inlet yarn guide, is wrapped several times around a feed drum and thereafter extends to an outlet yarn guide. In this case, the rotation of the drum feeds yarn constantly, whereby these devices are not suitable for supplying yarn intermittently. The drums of these feeders are usually metallic and the cylindrical surfaces thereof are polished, since with there being a plurality of wraps or turns of yarn around the drum, there is sufficient contact between the yarn and drum to cause the necessary pulling.

Figure 3:
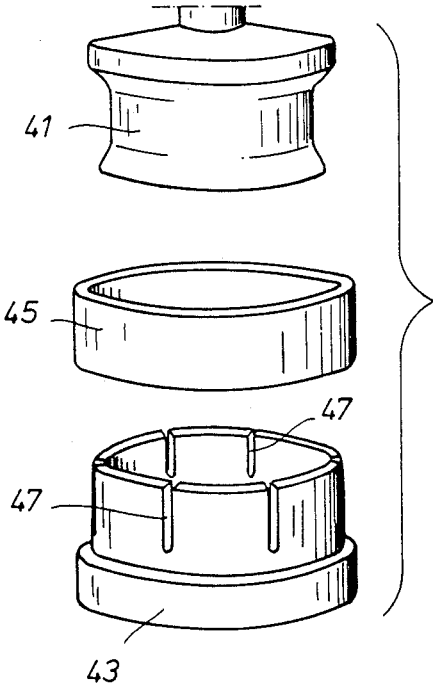
FIG. 3 is an exploded view of a drum sleeve and liner according to the present invention.

It should be highlighted that the invention starts out from a feeder of the type described in the foregoing paragraph, to which on the one hand there are added the corresponding intermediate yarn guides and, on the other hand, the conventional feed drum 41, illustrated in FIG. 3, is covered with a sleeve 43, previously provided with a rubber, leather, elastomeric or plastics liner 45. The sleeve may be provided with notches 47 or other known attachment means so that both the mounting and subsequent removal of the sleeve 43 may be facilitated, so that the feed device may provide the double utility of both types of feeder referred to above.

The intermittent feed device of the invention is particularly suitable for circular knitting machines. Nevertheless, the feed device is also suitable for feeding flat bed knitting machines, since during the area of non-operative stroke of the machine, the yarn is not fed, because the needles do not generate any tension, which is the common feature of jacquard machines. The feed device is also suitable for any textile machine requiring an intermittent yarn feed.

What we claim is:

1. In a yarn feed device for textile machines comprising an inlet yarn guide for receiving yarn from a yarn supply member; a feed drum having a cylindrical surface engageable by the yarn from the inlet yarn guide, the inlet yarn guide being disposed adjacent to and on a first side of said feed drum; means for causing said feed drum to rotate; and an outlet yarn guide from which the yarn is supplied to a needle of a textile machine, the improvement comprising:

a first intermediate yarn guide disposed substantially diametrally opposite said inlet yarn guide on an opposite side of the feed drum; and at least one second intermediate yarn guide substantially adjacent said inlet yarn guide, such that the yarn extending from the inlet yarn guide to the first intermediate yarn guide and from the latter to the second intermediate yarn guide maintains arcs of tangency with the drum substantially smaller than the total perimeter of the drum, and that the cylindrical surface of the feed drum is adapted to pull the yarn engaging the surface in the arcs of tangency only when the yarn is under tension, on being required by the needle.

2. The yarn feed device of claim 1, wherein there are two second intermediate yarn guides, situated on different sides of the inlet yarn guide and adapted to be used alternatively depending on the direction of rotation of the feed drum.

3. The yarn feed device of claim 1, wherein there is disposed a third intermediate yarn guide between the second intermediate yarn guide and the outlet yarn guide, such that the yarn passing between the third intermediate and the outlet yarn guide is located remote from and does not engage with the feed drum.

4. The yarn feed device of claim 1, wherein said cylindrical surface is formed by a non-metallic material.

5. The yarn feed device of claim 1, wherein said cylindrical surface of the drum is metallic, being provided with striations, knurling or other type of surface roughness.

6. The yarn feed device of claim 4, wherein the drum is surrounded by a removeable liner formed by a non-metallic material.

7. The yarn feed device of claim 6, further comprising a sleeve removeably mounted on the drum, wherein said liner is mounted around the sleeve.

8. The yarn feed device of claim 6, further comprising a sleeve, wherein the drum is a conventional feed drum and said sleeve is removably mounted around the conventional drum and said liner is mounted on said sleeve.

* * * * *